United States Patent [19]

Fugate

[11] Patent Number: 4,644,600

[45] Date of Patent: Feb. 24, 1987

[54] EXTENSION HANDLE FOR WRENCHES

[76] Inventor: Jimmy D. Fugate, 6623 S. 23rd St., Phoenix, Ariz. 85040

[21] Appl. No.: 723,344

[22] Filed: Apr. 15, 1985

[51] Int. Cl.[4] ..... B25F 1/00

[52] U.S. Cl. ..... 7/166; 81/177.2; 72/388

[58] Field of Search ..... 7/166, 169, 170; 72/388; 81/177.1, 177.2, 176.1, 177.7, 488; 16/114 R, 115; 74/544; 254/DIG. 3

[56] References Cited

U.S. PATENT DOCUMENTS

| | | | |
|---|---|---|---|
| 1,370,194 | 3/1921 | Cunha | 81/177.2 |
| 1,371,533 | 3/1921 | Wright | 81/177.2 |
| 1,417,338 | 5/1922 | Lenahan | 81/177.2 |
| 1,463,077 | 7/1923 | Gandell | 81/177.2 |
| 1,511,738 | 10/1924 | Lownsbery | 81/177.2 |
| 1,643,027 | 9/1927 | Morgan | 81/177.2 |
| 2,486,022 | 10/1949 | Haist et al. | 7/166 |
| 2,490,739 | 12/1949 | Nesbitt | 81/177.2 |
| 3,985,188 | 10/1976 | Steele | 74/544 |

*Primary Examiner*—Roscoe V. Parker

*Attorney, Agent, or Firm*—Don J. Flickinger; Jordan M. Meschkow

[57] ABSTRACT

An extension device for receiving the handle of a wrench so as to assist in the rotation thereof includes a generally flat handle portion, a generally flat offset portion coupled to the handle portion and offset therefrom and first and second stirrups coupled to opposite edges of the offset portion for receiving and positioning the handle of the wrench to be rotated such that the plane of rotation of the handle portion is coplanar with the plane of rotation of the handle of the wrench. Each stirrup includes a V-shaped portion having a first leg coupled to a respective edge of the offset portion and a substantially flat third leg coupled to the second leg of the V and extending over the offset portion. The handle of the wrench is received by the stirrups and positioned by the apex of each of the V-shaped portions. The extension device may also be used as a prybar and a device for bending pipe, metal rod and the like.

16 Claims, 7 Drawing Figures

EXTENSION HANDLE FOR WRENCHES

BACKGROUND OF THE INVENTION

1. Field of the Invention

This invention relates generally to an extension handle for wrenches, and more specifically to an improved extension handle for wrenches wherein the plane of rotation of the extension handle is substantially coplanar with the plane of rotation of the wrench to which the extension handle is coupled.

2. The Prior Art

The prior art is replete with devices for increasing the mechanical advantage of the user of a wrench. These prior art devices, however, all suffer from certain disadvantages. For example, many require the use of springs, spring catches, screws or other delicate fastening devices which result in a relatively expensive tool which is easily broken. Such a device is shown and described in U.S. Pat. No. 1,511,738 issued Oct. 14, 1924 and entitled EXTENSION HANDLE FOR WRENCHES AND OTHER TOOLS. Other known devices, for example the one shown and described in U.S. Pat. No. 1,643,027 issued Sept. 20, 1927 entitled EXTENSION HANDLE FOR WRENCHES are not configured so as to result in maximum torque. That is, efficiency is reduced since the plane of rotation of the extension handle is not the same as the plane of rotation of the wrench itself but is offset therefrom. Furthermore, the wrench is not sufficiently restrained by the extension handle resulting in possible slippage of the wrench in the handle.

SUMMARY OF THE INVENTION

It is an object of the present invention to provide an improved extension handle for wrenches.

It is further object of the present invention to provide an extension handle for wrenches which is simple and does not require the use of springs, spring catches, screws or other delicate fastening devices.

A still further object of the present invention is to provide an improved extension handle which may be used with a variety of wrenches; e.g. open ended, box ended, crescent, pipe wrench, etc.

A still further object of the present invention is to provide an extension handle for wrenches which is more efficient due to its unique construction.

A still further object of the present invention is to provide an improved extension handle incorporating stirrups which securely grip the wrench to which the extension is coupled.

A still further object of the present invention is to provide an improved extension handle for wrenches which by virtue of its construction may be used as a prybar.

Yet another object of the present invention is to provide an improved extension handle for wrenches which may also be utilized to bend pipe, metal rods, etc.

According to a broad aspect of the invention there is provided an extension device for receiving the handle of a wrench so as to assist in the rotation thereof, comprising a handle portion having first and second ends and first and second sides; an offset portion having first and second ends and first and second sides, the first end of the offset portion being coupled to the first end of the handle portion; and first means coupled to the offset portion for receiving and positioning the handle of the wrench such that the plane of rotation of the handle portion is coplanar with the plane of rotation of the handle of the wrench.

According to a further aspect of the invention there is provided an extension device for receiving the handle of a wrench so as to assist in the rotation thereof, comprising a handle portion having first and second ends and first and second sides; an offset portion having first and second ends and first and second sides, the first end of the offset portion being coupled to the first end of the handle portion; and at least first and second stirrups coupled to the first and second sides respectively of the offset portion, the first stirrup being coupled to the offset portion at its second end, and the second stirrup being coupled to the offset portion at a location intermediate the first stirrup and the second end of the offset portion, each of the stirrups comprising a V-shaped first portion having first and second legs and an apex, the first leg being connected to a respective edge of the offset portion; and a second portion connected to the second leg and extending over the offset portion, the handle of the wrench being received between the offset portion and the second portion of each of the first and second stirrups, the handle of the wrench being positioned by the apex of each V-shaped first portion.

The above and other objects, features and advantages of the present invention will be more clearly understood from the following detailed description taken in conjunction with the accompanying drawings, in which:

DESCRIPTION OF THE PREFERRED EMBODIMENT

Figure 1:
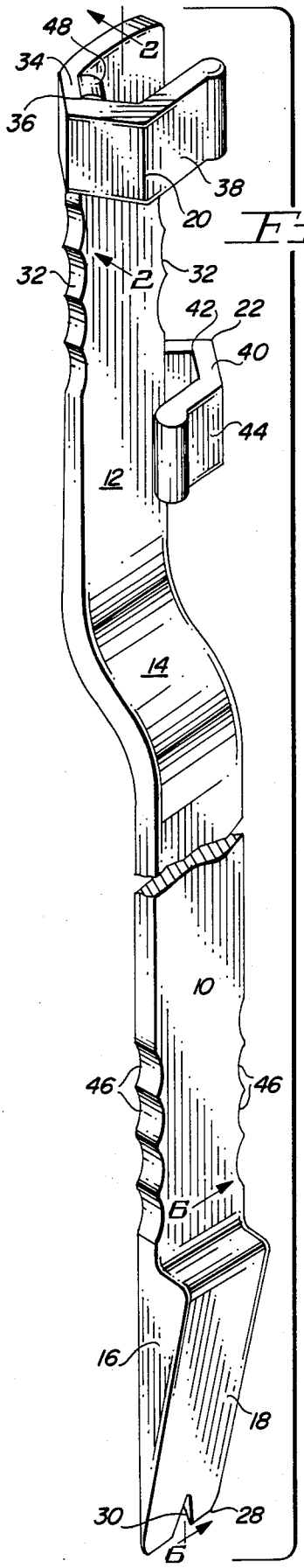
FIGS. 1, 4 and 5 are perspective, side and top views respectively of the inventive extension handle.
Figure 2:
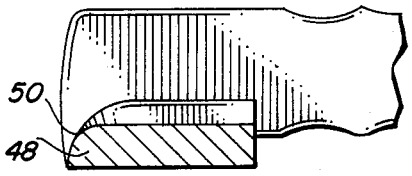
FIG. 2 is a cross-sectional view of the forward stirrup portion of the device shown in FIG. 1 taken along line 2—2.
Figure 4:
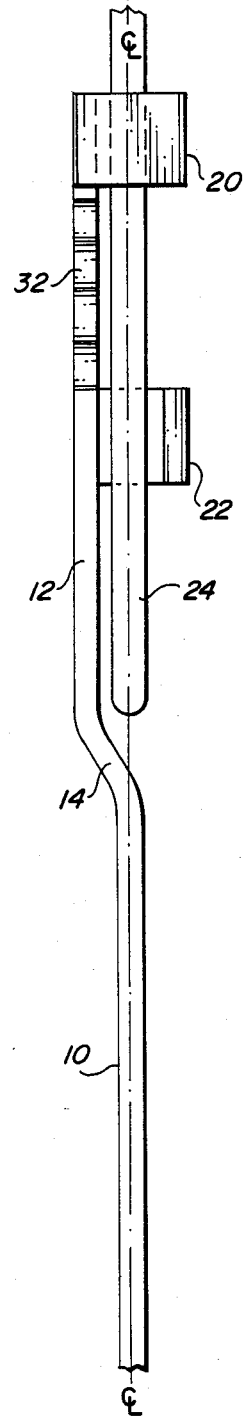
Figure 5:
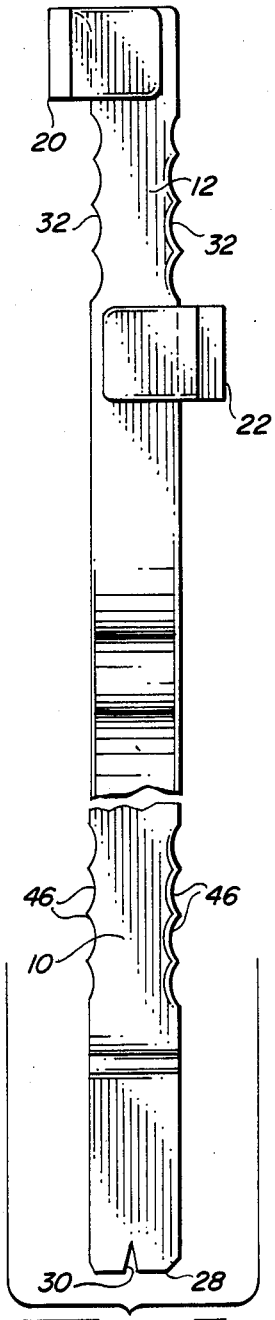

Referring to FIGS. 1, 4 and 5 which are perspective, side and top views of the inventive extension handle for wrenches, it can be seen the device comprises a generally flat handle portion 10 residing in a first plane, a generally flat offset portion 12 residing in a plane substantially parallel to the plane of the handle portion 10 but parallel thereto, an inclined portion 14 connecting handle portion 10 to offset portion 12, a wedge portion 16 coupled to an end of handle portion 10 opposite offset portion 12 and having an incline surface 18, and front and rear stirrups 20 and 22 respectively for gripping the handle or shank 24 of a wrench.

Figure 6:
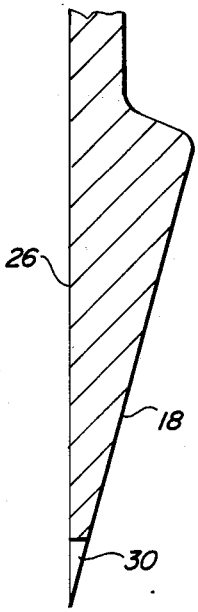
FIG. 6 is a cross-sectional view of the wedge portion of the device shown in FIG. 1 taken along line 6—6.
Figure 7:
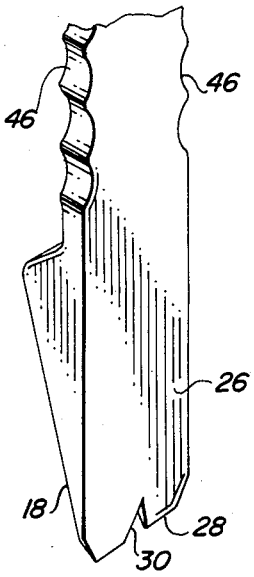
FIG. 7 is a perspective view of the wedge portion of the extension handle shown in FIG. 1.

Referring to FIGS. 1, 6 and 7, it can be seen that wedge portion 16 has an undersurface 26 which is contiguous with the undersurface of handle portion 10. The apex 28 of the wedge is provided with a V-shaped notch 30 therein which is utilized to engage for example the shank of a nail to be pried loose.

As a pry tool, the device is used in the well known manner. It should be noted, however, that due to the construction of the tool, the wedge may be used to pry nails loose in areas or regions wherein there is insufficient room for the claw of a hammer. It should also be pointed out that grooves 32 are provided in first and second edges of offset portion 12 which help the user grip this portion of the tool when utilizing wedge 16.

Stirrups 20 and 22 are coupled to opposite edges of offset portion 12 and extend thereabove in the direction of the plane of handle portion 10. As can be seen, stirrup 20 includes a V-shaped portion 34 having an apex 36 and a flat portion 38 which extends over offset portion 12. Similarly, stirrup 22 includes a V-shaped portion 40 having an apex 42 and a flat portion 44 extending over offset portion 12. To use the apparatus as an extension handle, the handle or shank of a wrench is slipped through the openings formed between the surface of offset portion 12 and flat portions 38 and 44 of stirrups 20 and 22 respectively. This is shown in FIG. 4. The measurements of stirrups 20 and 22 and the offset between handle 12 and offset portion 14 are chosen such that the plane of rotation of the wrench 24 and that of handle portion 10 are substantially coplanar when in use so as to maximize efficiency.

Figure 3:
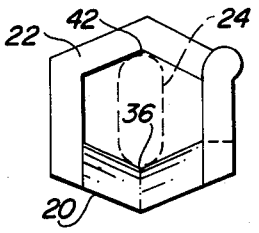
FIG. 3—3 illustrates how the handle or shank of a wrench is securely fastened within the stirrups of the inventive extension tool.

Referring to FIG. 3, it can be seen that the shank of the wrench 24 will be gripped and secured by apexes 36 and 42 of stirrups 20 and 22 respectively. Thus, it should be clear that to achieve and maintain the plane of rotation of shank 24 substantially coplanar with the plane of rotation of handle portion 10, apexes 36 and 42 of stirrups 20 and 22 respectively should likewise be coplanar with handle portion 10. Grooves 46 are provided on opposite edges of handle portion 10 to assist the user in gripping handle portion 10 when utilizing the apparatus as an extension tool.

Finally, apex 36 of stirrup 20 is provided with a raised longitudinal portion 48 having a curved forward surface 50 which may be utilized for the purpose of bending pipe or metal rod which is placed between stirrups 20 and 22.

Thus, there has been provided an extension for wrenches and the like which is structured and configured to provide maximum torque efficiency. Furthermore, the tool itself is multipurpose in that it may be also used as a prybar and a tool for bending pipe or metal rod. The tool requires no springs, spring catches, or other delicate components.

The above description is given by way of example only. Changes in form and details may be made by one skilled in the art without departing from the scope of the invention as defined by the appended claims.

I claim:

1. An extension device for receiving the handle of a wrench so as to assist in the rotation thereof, said device comprising:

a. a handle portion having first and second ends and first and second edges, and generally residing in a first plane;

b. an offset portion having a first end coupled to the first end of said handle portion and having a second end and first and second edges, and generally residing in a second plane substantially parallel to said first plane and offset therefrom by a predetermined distance; and c. first means including at least first and second stirrups coupled to the first and second edges, respectively, of said offset portion for receiving and positioning the handle of said wrench such that the plane of rotation of said handle portion is coplanar with the plane of rotation of the handle of said wrench.

2. A device according to claim 1 wherein said first stirrup is coupled to said offset portion proximate its second end, and said second stirrup is coupled to said offset portion at a location intermediate said first stirrup and the first end of said offset portion.

3. A device according to claim 2 wherein each stirrup comprises:

a V-shaped first portion having first and second legs and an apex, said first leg being connected to a respective edge of said offset portion; and a second portion connected to said second leg and extending over said offset portion, the handle of said wrench being received between said offset portion and the second portion of each of said first and second stirrups, said handle of said wrench being positioned by the apex of each V-shaped first portion.

4. A device according to claim 3 wherein said second portion of each of said first and second stirrups is generally parallel to a surface of said offset portion.

5. A device according to claim 3 further comprising a wedge portion coupled to the second end of said handle portion, said wedge portion having an apex with a notch therein so as to permit said device to be used as a prybar.

6. A device according to claim 3 wherein the apex of said V-shaped portion of said first stirrup has a curved forward surface so as to permit said device to be used to bend pipe and the like.

7. A device according to claim 3 further comprising contours in the first and second edges of said handle portion to facilitate the holding thereof.

8. A device according to claim 3 further comprising contours in the first and second edges of the offset portion to facilitate the holding thereof.

9. An extension device for receiving the handle of a wrench so as to assist in the rotation thereof, comprising:

a handle portion having first and second ends and first and second edges;

an offset portion having first and second ends and first and second edges, the first end of said offset portion being coupled to the first end of said handle portion; and at least first and second stirrups coupled to the first and second edges respectively of said offset portion, said first stirrup being coupled to said offset portion at its second end, and said second stirrup being coupled to said offset portion at a location intermediate said first stirrup and the second end of said offset portion, each of said stirrups comprising i. a V-shaped first portion having first and second legs and an apex, said first leg being connected to a respective edge of said offset portion; and ii. a second portion connected to said second leg and extending over said offset portion, the handle of said wrench being received between said offset portion and the second portion of each of said first and second stirrups, said handle of said wrench being positioned by the apex of each V-shaped first portion.

10. A device according to claim 9 wherein said first and second stirrups receive and position the handle of said wrench such that the plane of rotation of said handle portion is substantially coplanar with the plane of rotation of the handle of said wrench.

11. A device according to claim 10 wherein said handle portion generally resides in a first plane, said offset portion generally resides in a second plane, and said first and second planes are offset by a predetermined distance.

12. A device according to claim 10 wherein the second portion of each of said first and second stirrups is generally parallel to a surface of said offset portion.

13. A device according to claim 10 further comprising a wedge portion coupled to the second end of said handle portion, said wedge portion having an apex with a notch therein so as to permit said deivce to be used as a prybar.

14. A device according to claim 10 wherein the apex of said V-shaped portion of said first stirrup has a curved forward surface so as to permit said device to be used to bend pipe and the like.

15. A device according to claim 10 further comprising contours in the first and second edges of said handle portion to facilitate the holding thereof.

16. A device according to claim 10 further comprising contours in the first and second edges of said offset portion to facilitate the holding thereof.

* * * * *